US007494117B2

(12) United States Patent
Peier

(10) Patent No.: US 7,494,117 B2
(45) Date of Patent: Feb. 24, 2009

(54) SIGNATURE GATHERER WITH DETACHABLE FEEDERS

(75) Inventor: Thomas Peier, Zofingen (CH)

(73) Assignee: Muller Martini Holding AG, Hergiswil (CH)

( * ) Notice: Subject to any disclaimer, the term of this patent is extended or adjusted under 35 U.S.C. 154(b) by 0 days.

(21) Appl. No.: 10/225,346

(22) Filed: Aug. 22, 2002

(65) Prior Publication Data

US 2003/0047857 A1 Mar. 13, 2003

(30) Foreign Application Priority Data

Aug. 22, 2001 (EP) ..... 01810814

(51) Int. Cl.
*B65H 3/00* (2006.01)
*B65H 29/00* (2006.01)

(52) U.S. Cl. ..... 270/52.26; 270/52.14; 270/52.16; 270/52.27; 270/52.29; 270/52.18

(58) Field of Classification Search ..... 270/52.14, 270/52.16, 52.26, 52.29, 52.27, 52.18
See application file for complete search history.

(56) References Cited

U.S. PATENT DOCUMENTS 3,809,385 A * 5/1974 Rana ..... 270/52.29
4,177,979 A * 12/1979 Orsinger et al. ..... 270/52.16
4,482,141 A 11/1984 Moser
4,564,186 A * 1/1986 Clarke et al. ..... 270/52.29
4,747,592 A * 5/1988 Pessina et al. ..... 271/13
5,013,019 A * 5/1991 Samuels ..... 270/1.02
5,013,022 A * 5/1991 Graushar ..... 270/56
5,067,700 A * 11/1991 Dick ..... 270/52.29
5,100,116 A * 3/1992 Graushar ..... 270/1.02
5,197,590 A * 3/1993 Prim et al. ..... 198/300
5,516,090 A * 5/1996 Chang ..... 270/52.15
5,732,941 A * 3/1998 Moll ..... 271/10.07
6,267,366 B1 * 7/2001 Graushar et al. ..... 270/1.02
6,832,758 B2 * 12/2004 Richter et al. ..... 271/8.1
2002/0043753 A1 * 4/2002 Richter et al. ..... 270/58.07

FOREIGN PATENT DOCUMENTS

EP 0 718 225 A2 6/1996

(Continued)

OTHER PUBLICATIONS http://www.printingnews.com/pages.issues/2000/52900_drupa.shtm; p. 5 of 9.*

(Continued)

*Primary Examiner*—Gene Crawford
*Assistant Examiner*—Leslie A Nicholson, III
(74) *Attorney, Agent, or Firm*—Venable LLP; Robert Kinberg; Catherine M. Voorhees

(57) ABSTRACT

A device for gathering signatures, positioned straddling, into printed products such as newspapers, magazines, and brochures includes a conveying arrangement that has a saddle-shaped gathering section, and at least one signature feeders. The at least one signature feeder is arranged along the gathering section and are respectively controlled via a motor with the same or changeable angle of rotation and are driven cycle-synchronously with the conveying arrangement. For this, the signature feeders are connected detachably to a machine frame that accommodates the conveying arrangement.

14 Claims, 2 Drawing Sheets

FOREIGN PATENT DOCUMENTS

| | | | | |
|---|---|---|---|---|
| EP | 0917965 | A1 | * | 5/1999 |
| EP | 1156003 | A2 | * | 5/2000 |
| EP | 1024099 | A1 | | 8/2000 |
| EP | 1072546 | A1 | | 1/2001 |
| JP | 4269594 | | | 9/1992 |
| JP | 6-191176 | A | * | 7/1994 |

OTHER PUBLICATIONS

Heidelberg, Stitchmaster ST 400—Overview.*
Heidelberg, Stitchmaster ST-400 Feeders.*
Stitchmaster ST 400 brochure.*
Müller Martini, Issue AMRYS/9412/M1/D, pp. 1-4.

* cited by examiner

SIGNATURE GATHERER WITH DETACHABLE FEEDERS

CROSS-REFERENCE TO RELATED APPLICATION

This application claims the priority of European Patent Application No. 01810814.2 filed on Aug. 22, 2001, the disclosure of which is being incorporated herein by reference.

BACKGROUND OF THE INVENTION

The invention relates to a device for gathering signatures, conveyed straddling, into printed products, such as newspapers, magazines, brochures and the like. The device consists of a conveying arrangement that forms a saddle-shaped gathering section and has signature feeders arranged along the gathering section, which are respectively controlled with the same or a changeable angle of rotation and driven cycle-synchronous with the conveying arrangement.

A device of the aforementioned type is installed, for example, in a gathering and wire-stitching machine referred to as "Prima mit AMRYS" [excellent with AMRYS] and is acknowledged in a prospectus by MULLER MARTINI, Issue AMRYS/9412/M1/D. A gathering and wire-stitching machine of this type has been used in the printing office of a Swiss Publishing House since 1994.

A gathering and wire-stitching machine equipped with so-called servomotors for each signature feeder and the conveying arrangement is disclosed in Japanese Unexamined Published Patent Application 04-269594 A.

It has been known for some years to persons skilled in the art of the print-processing and the print subsequent treatment industry that over a broad application range, machines with working-cycle connected processing stations—following mechanical superimposition drives—can now be equipped with independently controlled or regulated drive motors. This is due to the fact that motors controlled with the same angle of rotation or a changeable angle of rotation have been made available in recent years. Consequently, the purchasing costs of such motors have continued to drop.

SUMMARY OF THE INVENTION

It is an object of the present invention to take design measures for a device of the aforementioned type, or a gathering and wire-stitching machine, so that the feeders, equipped with an individual drive, can be interchanged along the effective conveying arrangement.

This object is solved according to the invention in that the signature feeders are detachably connected to a machine frame for the conveying arrangement.

As a result, complete feeder units can be exchanged or replaced easily with the aid of a forklift or other lifting devices.

A frame part preferably forms the machine frame for attaching at least one signature feeder, thus ensuring a quick structural change in the gathering and wire-stitching machine.

Machine frame parts designed for two signature feeders have also proven suitable as simple components for a structural reconfiguration.

The machine frame advantageously has several frame parts, lined up parallel to the conveying arrangement, which make it possible to restart the operation of a gathering and wire-stitching machine within a short time because of the fast and exact assembly.

For creating feeder units that can be made operational within a short time, it has proven advantageous if the signature feeders are connected to the machine frame such that they can be secured and can be adjusted to change the distance relative to the conveying arrangement.

It is useful if the signature feeders are respectively connected with a support to the machine frame or the frame parts and in a preferred embodiment, they may be detachable from one another.

An adjustment device is preferably provided between support and signature feeder, which makes it easy to adjust or change the distance between a signature feeder and the conveying arrangement.

Of course, the adjustment device could also be arranged between support and machine frame or frame part.

The adjustment device is designed to adjust the signature feeders three-dimensionally. That is, the signature feeders can be adjusted to the side and in height, so that each signature feeder can be adjusted individually relative to the conveying arrangement.

A motorized control for the adjustment and change of the signature feeder may be employed in a preferred embodiment.

A support proves to be suitable for accommodating a control device for the associated signature feeder.

A signature feeder with an associated support and at least a part of an adjustment device advantageously forms a processing unit that can be exchanged or can be added in order to expand a gathering and wire stitching machine, wherein the unit should be easy to install or exchange.

The supports for the signature feeders can be installed advantageously between the side plates of two frame parts, which form a stable machine frame when strung together.

The frame parts are preferably designed such that they can be leveled and are provided with a leveling device for this purpose.

The frame part and support are advantageously designed such that they can be joined, so that the supports can be inserted into the frame parts, for example by inserting or lowering them between side guides.

The frame parts are advantageously designed so as to conduct compressed air and a vacuum inside pipelines for the signature feeders. Line segments are provided for this and can be connected between the frame parts.

Gathering devices of the type mentioned here can be connected at the conveying end to a suitable wire-stitching device of a gathering and wire-stitching machine and can be controlled jointly. In this preferred embodiment, the conveying arrangement may also extend with cycle-synchronous movement into and past the wire-stitching region.

In the following, the invention is explained with the aid of an exemplary embodiment and by referring to the drawings, to which we refer for all details not further explained in the specification.

DETAILED DESCRIPTION OF THE INVENTION

Figure 1:
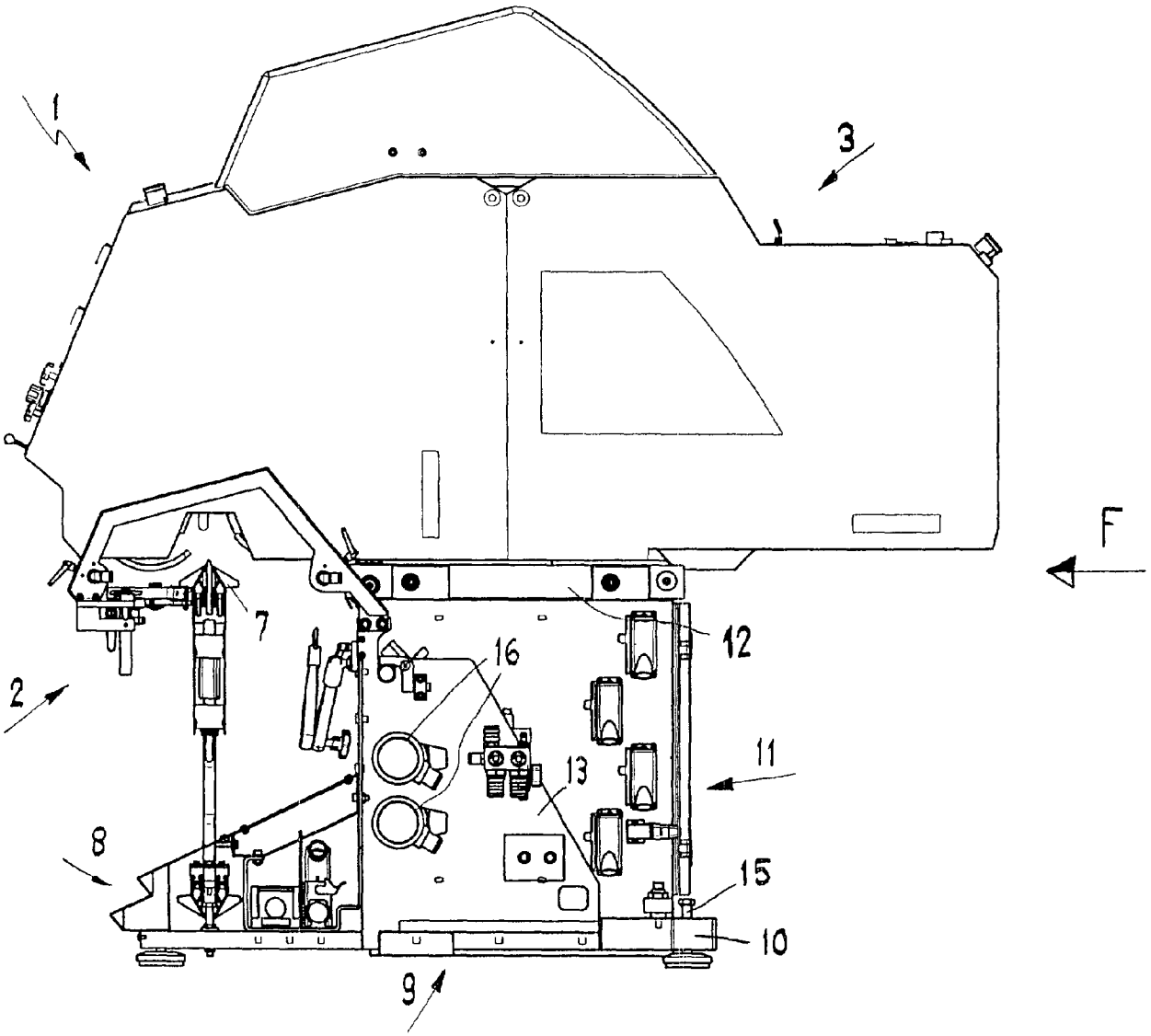
FIG. 1 is a view from the side of a gathering device mounted on a machine frame.
Figure 2:
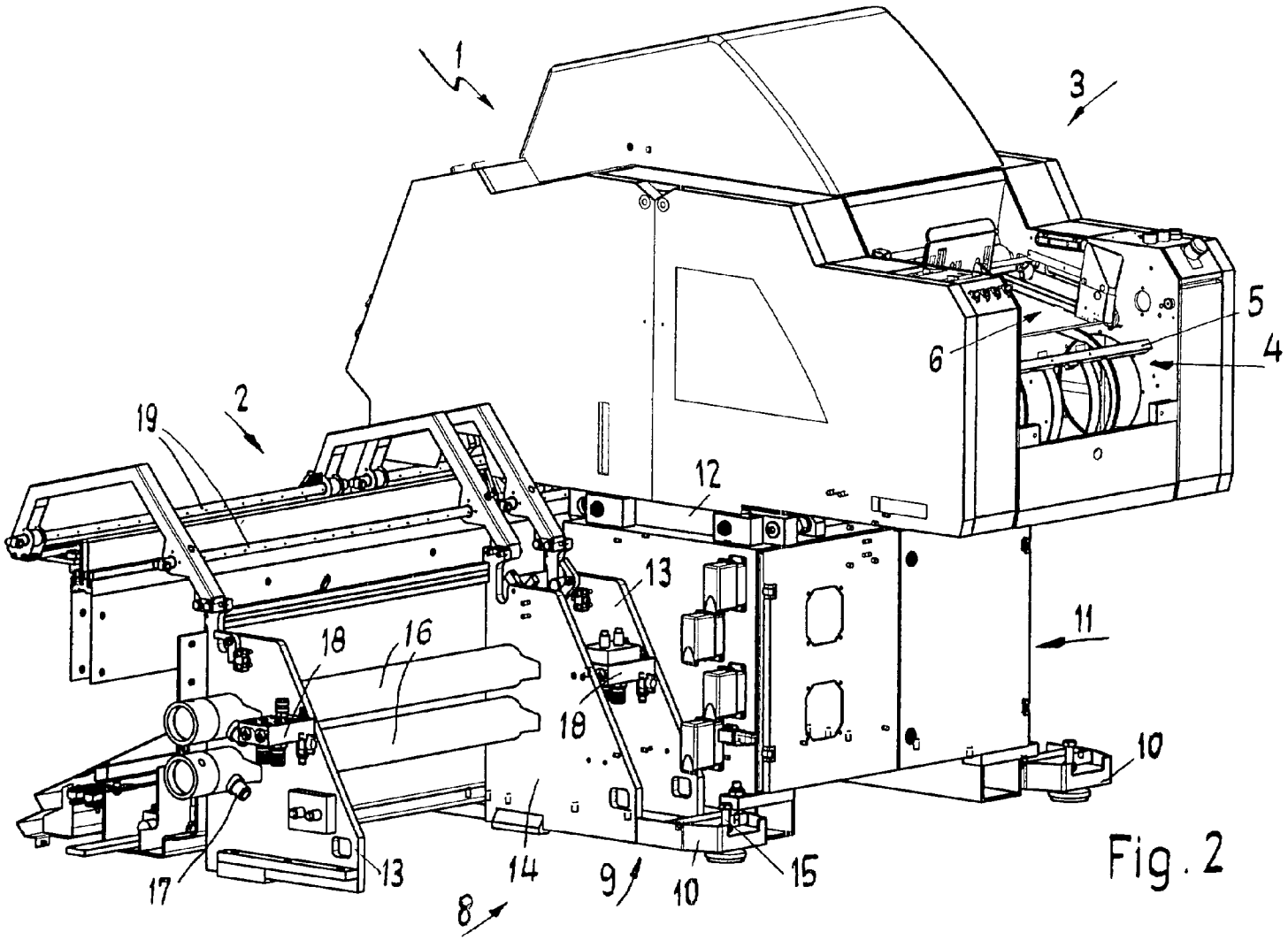
FIG. 2 is a three-dimensional representation of the gathering device, as seen in arrow direction F in FIG. 1.

FIGS. 1 and 2 illustrate a gathering device 1 for a gathering and wire-stitching machine, which comprises several signature feeders 3 along a conveying arrangement 2. A signature feeder 3, as shown, includes a conveying drum 4 driven by an electric motor and a gripping device 5 along the circumference, which pulls off signatures from an above-arranged magazine 6. The signatures are then transferred to an opening device, containing two counter-rotating opening drums, from which the signatures are dropped spread apart onto the conveying arrangement 2. Feeders of the aforementioned type are known and are described, among other things, in European patent number EP 0 718 225 A2.

According to one embodiment of the invention, the conveying arrangement 2 includes a saddle-shaped support on which the signatures rest in a straddling position and on which the signatures are conveyed by a carrier 7 at a rear edge in conveying direction passes the signature feeders 3. The signature feeders 3 that are strung together side-by-side, only one of which is shown in FIGS. 1 and 2, determine the length of a conveying section for the present conveying arrangement 2. The signature feeders 3 are driven with the same or a changing angle of rotation and are controlled to operate synchronously or cycle-synchronously with the conveying arrangement 2. For that purpose, the signature feeders 3 are provided with controllable electric motors for adapting the individual signature feeders to the movement or speed of the conveying arrangement, for example based on the different characteristics of the signatures.

In the interest of having short operating, set-up, assembly and replacement times, the signature feeders 3 are installed on a machine frame 8, so as to be detachable. The machine frame 8 is connected to the conveying arrangement 2, along which the gathered signatures are transported below the signature feeders 3.

FIG. 2 shows a machine frame 8, designed for accommodating two signature feeders 3. The machine frame 8 shown herein can also be used as frame part 9 for a gathering and wire-stitching machine 1 with more than two signature feeders 3. In that case, several frame parts 9 are lined up side-by-side and are fixedly connected.

The left end of frame part 9, shown in FIG. 2, is designed such that additional frame parts 9 can be installed, wherein the missing support is made available by a machine base 10 of the adjacent frame part 9 and the complete unit can be called a modular structure for a machine frame 8.

The same design principle for frame part 9 could also be used for only one signature feeder 3. Each signature feeder 3 is mounted on a separate support 11, belonging only to this feeder, which takes over the secure connection between a signature feeder 3 and the machine frame 8 and/or a frame part 9.

An adjustment device 12 is provided between signature feeder 3 and support 11 for adjusting or changing the distance between a signature feeder 3 and the conveying arrangement 2 that gathers the signatures. The adjustment device is designed for adjusting or changing the height and side position of the signature feeder 3, relative to the position of a signature on the conveying arrangement 2. As previously mentioned in the above, the distance could be adjusted or changed either manually or motorized, or with the aid of a programmed control. Options of this type are known for gathering and wire-stitching machines.

In a preferred embodiment, support 11 may have a hollow design, which is particularly suitable for accommodating a control device for the signature feeders 3. FIG. 2 shows a connector arrangement intended for the control device on the outside of support 11. The representation in FIG. 2 shows a feeder unit containing signature feeder 3, adjustment device 12 and support 11, all of which can be easily removed or replaced with the aid of a lift truck or forklift or any other type of lifting device.

A feeder unit is respectively installed between two side panels 13, 14 of a frame part 9. The frame part can also be designed for one feeder unit only, in which case it would be approximately half as long as the frame part 9 shown herein.

The frame part 9 is provided with a plurality of leveling devices 15 in the region of the machine base, so that the frame part 9 may be mutually aligned with another frame part.

In order to conduct compressed air and/or provide a vacuum that is employed to operate the signature feeders 3, the frame parts 9 are provided with pipeline segments 16, which penetrate the side panels 13, 14 parallel to the conveying arrangement 2, and on which pipe connectors 17 are arranged for tapping the medium. Controllable valves 18 are furthermore installed on the side panels 13, which supply the selected energy via hoses, not shown herein, to the pneumatically operated signature guides 19 or the suction devices of a signature feeder 3 (not shown). The pipe sections 16 of a feeder unit can be connected with couplings to the pipe sections of adjacent feeder units. Of course, the pipes are provided with end caps (not shown herein).

A gathering device 1 of the proposed type can be designed such that it can be connected on the conveying end to a wire-stitching device of a gathering and wire-stitching machine.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A device for gathering signatures, conveyed straddling, to form printed products, said device comprising:

a conveying arrangement, which forms a saddle-shaped gathering line over which the signatures are positioned straddling;

a machine frame for the conveying arrangement having a plurality of frame parts lined up side-by-side and connected to the conveying arrangement;

at least one signature feeder that is arranged along the gathering line of the conveying arrangement, said at least one signature feeder being respectively driven by the same or a changeable angle of rotation and being controlled to operate synchronously with the conveying arrangement, said at least one signature feeder being connected to the machine frame via a secured connection such that it can be adjusted and secured in place to adjust or change the distance relative to the conveying arrangement;

a separate support upon which each at least one signature feeder is respectively mounted; and a height and side adjustment device for adjusting or changing the distance between the at least one signature feeder and the conveying arrangement, the adjustment device being arranged between the separate support and the respective, at least one signature feeder wherein the adjustment device is designed for adjusting the height and side position of the signature feeder relative to the conveying arrangement;

wherein the at least one signature feeder is respectively connected detachably via the separate support to at least one of the frame parts of the machine frame in a secured connection, said plurality of frame parts of said machine frame being formed by at least two frame parts that are arranged in a row parallel to the conveying direction and accommodate the conveying arrangement, and wherein the separate support for the at least one signature feeder is mounted detachably on a frame part of the machine frame, the frame part of the machine frame having two side panels for detachably receiving the separate support by inserting the separate support between side guides of the frame part.

2. The device according to claim 1, wherein the separate support has a hollow space for accommodating a control device that controls the at least one signature feeder.

3. The device according to claim 1, wherein the at least one signature feeder, the separate support and at least a portion of the adjustment device form a single unit that can be replaced.

4. The device according to claim 1, wherein at least two signature feeders and two frame parts having side panels are provided and further comprising at least two supports associated with the machine frame and to which the signature feeders are respectively arranged between the side panels of the two frame parts.

5. The device according to claim 4, wherein the frame parts are designed such that they can be leveled.

6. The device according to claim 4, wherein a frame part and a support are designed such that they can be joined together.

7. The device according to claim 1, wherein the machine frame is designed for conducting compressed air and providing a vacuum to the at least one signature feeder.

8. The device according to claim 1, wherein a conveying end of the device is designed to be connected to a wire-stitching device of a gathering and wire-stitching machine.

9. A device for gathering signatures, conveyed straddling, to form printed products, said device comprising:

a conveyor, which forms a saddle-shaped gathering line over which the signatures are positioned straddling;

a machine frame for accommodating the conveyor, said machine frame having a plurality of frame parts lined up side-by-side;

at least one signature feeder being disposed along the gathering line of the conveyor, said at least one signature feeder being respectively driven by the same or a changeable angle of rotation and synchronous with the conveyor;

a separate support on which each at least one signature feeder is respectively mounted, wherein the at least one signature feeder is respectively connected detachably via the separate support to at least one of the frame parts of the machine frame in a secured connection, said plurality of frame parts of said machine frame being formed by at least two frame parts that are arranged in a row parallel to the conveying direction and accommodate the conveyor, and wherein the separate support for the at least one signature feeder is mounted detachably on a frame part of the machine frame, the frame part of the machine frame having two side panels for detachably receiving the separate support by inserting the separate support between side guides of the frame part; and a height and side adjustment device disposed between the separate support and the at least one signature feeder for changing the distance between the at least one signature feeder and the conveyor.

10. The device according to claim 9, wherein at least two signature feeders and two frame parts having side panels are provided and further comprising at least two supports associated with the machine frame and to which the signature feeders are respectively arranged between the side panels of the two frame parts.

11. The device according to claim 10, wherein the frame parts each have a leveling device.

12. The device according to claim 10, wherein a frame part and a support are joinable to one another.

13. The device according to claim 10, wherein the machine frame further includes a pipe and a pipe connector for conducting compressed air and providing a vacuum to the at least one signature feeder.

14. A device for gathering signatures, conveyed straddling, to form printed products, said device comprising:

a conveyor, which forms a saddle-shaped gathering line over which the signatures are positioned straddling;

a machine frame for accommodating the conveyor, said machine frame having a plurality of frame parts lined up side-by-side;

at least one signature feeder that is arranged along the gathering line of the conveyor, said at least one signature feeder being respectively driven by the same or changeable angle of rotation and synchronous with the conveyor;

a support on which the at least one signature feeder is mounted; and a height and side adjustment device for adjusting or changing the distance between signature feeder and the conveyor, the adjustment device being arranged between the support and the respective, at least one signature feeder wherein the adjustment device is designed for adjusting the height and side position of the signature feeder relative to the conveyor, wherein the at least one signature feeder is respectively connected detachably via the support to at least one of the frame parts of the machine frame in a secured connection, said plurality of frame parts of said machine frame being formed by at least two frame parts that are arranged in a row parallel to the conveying direction and accommodate the conveyor, wherein the support for the at least one signature feeder is mounted detachably on a frame part of the machine frame and the frame part of the machine frame has two side panels for detachably receiving the support by inserting the support between side guides of the frame part, and wherein the at least one signature feeder is adjustably connected to the machine frame so that it can be adjusted and secured in place to adjust or change the distance relative to the conveyor.

* * * * *